US005894933A

United States Patent [19]

Crews et al.

[11] Patent Number: 5,894,933

[45] Date of Patent: Apr. 20, 1999

[54] STACKABLE MERCHANDISING CONTAINER

[76] Inventors: Mitchell S. Crews, 1021 Westfield Course, Geneva, Ill. 60134; Michael M. Lloyd, 1201 S. 13th St., Rogers, Ark. 72758

[21] Appl. No.: 09/106,560

[22] Filed: Jun. 29, 1998

[51] Int. Cl.[6] ..... B65D 21/02

[52] U.S. Cl. ..... 206/750; 206/751

[58] Field of Search ..... 206/736, 747, 206/748, 749, 750, 745, 751, 755, 45.24, 45.25, 45.26, 769, 772, 503

[56] References Cited

U.S. PATENT DOCUMENTS

| | | | |
|---|---|---|---|
| 2,502,561 | 4/1950 | Ebest | 206/750 |
| 5,772,110 | 6/1998 | Garretson | 206/750 X |

OTHER PUBLICATIONS

Photographs (4) of a convertible display container, having an integrated cover, from an unknown manufacturer, believed to be commercially available by approximately 1994.

Photographs (7) of a convertible display container, having an integrated cover, manufactured by Stone Container Corporation and first offered for sale in 1997.

*Primary Examiner*—Jacob K. Ackun
*Attorney, Agent, or Firm*—Dick & Harris

[57] ABSTRACT

A container apparatus for the packaging, storage and transportation of articles, in which the apparatus may be articulated from a substantially enclosed container configuration to a stackable point-of-purchase display configuration. When in the display configuration the cover of the apparatus acts to present the articles within the container at repeatedly stackable, acute angle—respective to a level surface, for the viewing of the articles. Additionally, when in the display configuration, the container apparatus may be vertically or horizontally stacked on another similarly configured container apparatus with stability and without entirely obscuring the presentation of the articles contained therein.

19 Claims, 3 Drawing Sheets

STACKABLE MERCHANDISING CONTAINER

BACKGROUND OF THE INVENTION

The present invention relates in general, to a point of purchase container apparatus and, in particular, to a shelf-top point of purchase container apparatus that can be used for not only displaying articles on retail outlet shelves but also for the packaging, storage and transportation of the same articles during shipment to such retail outlets.

Containers convertible from storage and transporting articles towards acting as point of purchase display units have been used for many years. Such early containers were nothing more than a box with a removable and detachable lid, such as a conventional shoe box. If the articles in the container were to be displayed, the lid would be removed and then either attached to the bottom of the container or discarded.

While functional, such arrangements did not present the articles being displayed in the most effective "merchandising" fashion. These prior art display containers would normally lie flat, horizontally on the counter or shelf. One could not vertically stack the display containers or the articles contained in the lower display container would be hidden from view. Moreover, very often the covers for the containers would become lost or misplaced.

Other display containers have been developed in which the covers or lids are attached. During the transformation from storage and transportation to point of purchase display, the cover of such prior art container rolls back and underlies the lower displaying portion of the container. This arrangement allowed the lower displaying portion to be placed on an angle for a more pleasing presentation of the articles within the container. While providing a better display of the articles, these type of container apparatus could still not be restrainably stacked, either vertically or horizontally unless the view of the articles within the lower container was obscured. Likewise, attempts to stack often resulted in toppling, breakage or separation or displayed goods and the like.

It is thus an object of the present invention to create an inexpensive, easy to assemble point of purchase container apparatus that can be utilized not only for the display of articles but that can also be utilized in the packaging, storage and transportation of such articles.

It is a further object of the invention to provide a point of purchase container apparatus that may be stacked on a shelf, from the floor up or some other level surface—not only horizontally but also vertically in a substantially stable manner while permitting a substantially unobscured view of at least a portion of the articles within not only the top container but the lower stacked upon containers as well.

These and other objects of the invention will become apparent in light of present specification and drawings.

SUMMARY OF THE INVENTION

The invention comprises a container apparatus for the packaging, storage and transportation of articles, which container may be articulated from a substantially enclosed configuration to a stackable point-of-purchase display apparatus. The container apparatus includes a tray portion and a cover portion capable of positioning over the tray portion. The tray portion is formed from a bottom panel, a front panel, a back panel and two opposing side panels, wherein the bottom panel has a front edge, a back edge, and opposing side edges. Preferably, the front panel, which emanates from the front edge of the bottom panel and extends substantially perpendicularly to the bottom panel, has two opposing end edges and an upper edge, while the back panel, which also has two opposing end edges and an upper edge, emanates from the back edge of the bottom panel and extends substantially perpendicular to the bottom panel.

The two side panels, of this embodiment, emanate from the respective opposed side edges of the bottom panel and extend substantially perpendicular to the bottom panel, with each have two opposed end edges and an upper edge. The end edges of each side panels adjoin the end edges of the back and front panels so as to form the tray portion of the container apparatus.

The cover portion of the container apparatus emanates from the upper edge of the back panel. The cover includes a top member positioned so as to overlie the open top of the tray portion. It is preferred that the top member is folded proximate to the upper edge of the back panel, at the top/back panel fold, and then again folded about a top panel fold, which is positioned proximate to the back edge of the bottom panel. The top panel fold divides the top member into a front top panel and rear top panel, which extends from said top/back panel fold to said top panel fold. In folding the top member in such a fashion the rear top panel is substantially overlying the back panel while the front top panel is underlying a portion of the bottom panel.

The cover also includes at least one display orientation member, emanating from at least the front or rear top panels so as to maintain the tray portion on an inclined position when the container apparatus is in the display configuration. In this preferred configuration, the container may be vertically or horizontally stacked upon another similar configured container so that substantially one-half of the interior region of the tray portion of each stacked apparatus is exposed.

The at least one display orientation member may be a single orientation panel which is foldably attached and substantially perpendicular to the front top panel. It is preferred that the orientation panel is of substantially the same height and width as the front panel of the tray portion. Alternatively, the at least one display orientation member may be at least one wing member positioned attached to at least a portion of the front panel at one of the side edges of the front top panel. Alternatively, there may be two wing members, each of which are attached to a respective side edge of the front top panel and are dimensioned so as to be substantially equal in height to the height of the front panel.

It is preferable that the at least one display orientation member includes an inner and outer orientation panel, a first and second wing flap and a first and second cover support flap. The outer orientation panel has a front edge, a back edge and two opposed side edges and is foldably attached and substantially perpendicular to the top member and extends the length of the front top panel. The inner orientation panel is dimensioned substantially similar to the outer orientation panel and is foldably attached to it at its front edge.

The first and second wing flaps of this embodiment are hingedly attached to at least a portion of the front top panel. The first and second cover support flaps emanate from respective first and second wing flaps and are foldable so as to be substantially perpendicular to the wing flaps and the front top panel at a location proximate. The inner orientation panel is then folded about the front edge of the outer orientation panel so that the cover support flaps are positioned between the inner and outer orientation panels.

The invention may also include internal side walls and internal side support flaps, where the internal side support flaps emanate from each of the opposing end edges of the front and back panels so as to be foldable to a position substantially perpendicular to said bottom, front and back panels and positioned between said internal side walls and said side panel, while the internal side walls emanate from the upper edge of said side panels of said tray portion so as to be foldable about said respective upper edge of the side panels to a position substantially perpendicular to the bottom panel and substantially parallel and adjacent to respective side panels.

Towards retaining the cover support flaps in their configuration the inner orientation panel includes locking members. These locking members preferably are one or more locking tabs positioned so as to restrict movement of the inner orientation panel wall upon positioning the inner orientation panel overlying the first and second cover support flaps and said outer orientation panel. These one or more locking tabs are removably insertable into respective one or more apertures correspondingly positioned within the front top panel proximate.

Similarly, each of the internal side walls includes tray portion locking means. The tray portion locking means are preferably one or side locking tabs positioned so as to restrict movement of the internal side walls upon positioning of the internal side walls substantially perpendicular to the bottom panel and substantially parallel and adjacent to the side panels. The side locking tabs are removably insertable into corresponding apertures positioned within the bottom panel proximate to its side edges.

In a preferred embodiment of the invention, the display orientation member would maintain the tray portion at a substantially 45 degree angel of incline when in the display configuration. Towards maintaining the preferred incline, the invention would also include locking members for maintenance of the cover portion in its display configuration. This locking member can be accomplished by a locking tab and aperture combination where the locking tab is positioned within the front top panel. The aperture is correspondingly positioned in the bottom panel for fixed receipt of the locking tab when the front top panel underlies the bottom panel.

To ease the articulation of the container apparatus into its display configuration, the apparatus contains a tension relief aperture positioned within at least a portion of the rear top panel and a portion of the back panel. This tension relief aperture is preferably positioned between the side edges of the back panel and may be substantially bisected by the top/back fold.

While the invention may be formed from a variety of materials, it is preferable that the invention be formed from a unitary blank of substantially biodegradable material, such as paperboard or corrugated paperboard.

DETAILED DESCRIPTION OF THE DRAWINGS

Figure 1:
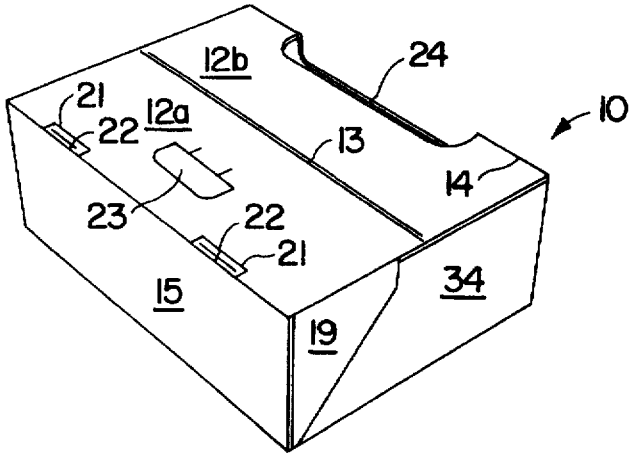
FIG. 1 is a perspective view of the fully articulated container apparatus configured for the packaging, storage and transportation of articles.

While this invention is susceptible of embodiment in many different forms, there is shown in the drawings and will herein be described in detail, several specific embodiments, with the understanding that the present disclosure is to be considered as an exemplification of the principles of the invention and is not intended to limit the invention to the embodiments as illustrated.

Container apparatus 10 of the present invention is shown in FIGS. 1–7. Specifically, container apparatus 10 comprises cover 11 and tray 30. When configured for packaging, storage and transportation of articles as shown in FIG. 1, container apparatus 10 forms a substantially enclosed box. Articles are placed inside tray 30, which is preferably formed into a substantially rectangular configuration and enclosed with cover 11.

Figure 2:
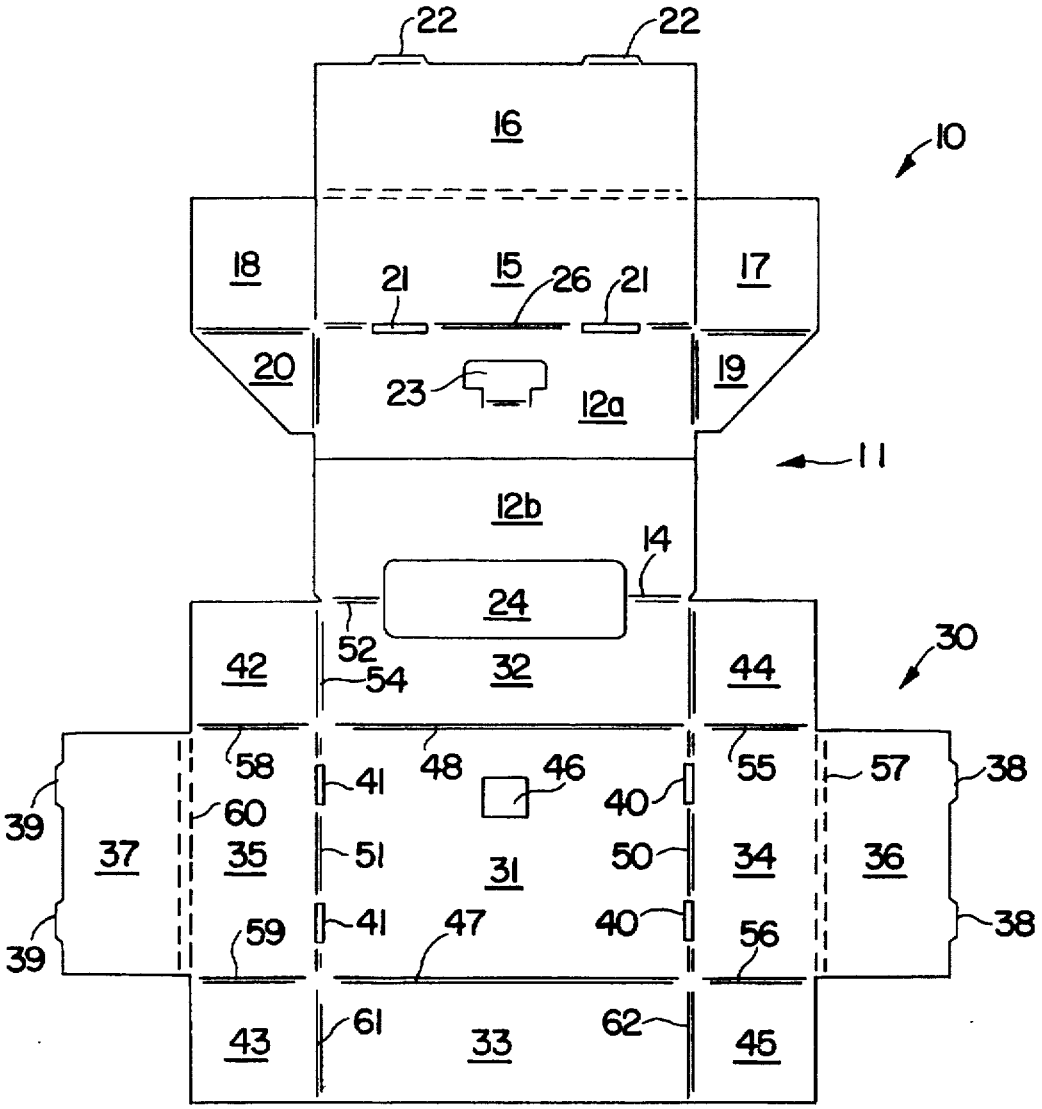
FIG. 2 is an elevated view of the blank for the non-articulated container apparatus, comprising a single sheet of unitary material containing both the tray portion and the cover portion of the container apparatus.
Figure 3:
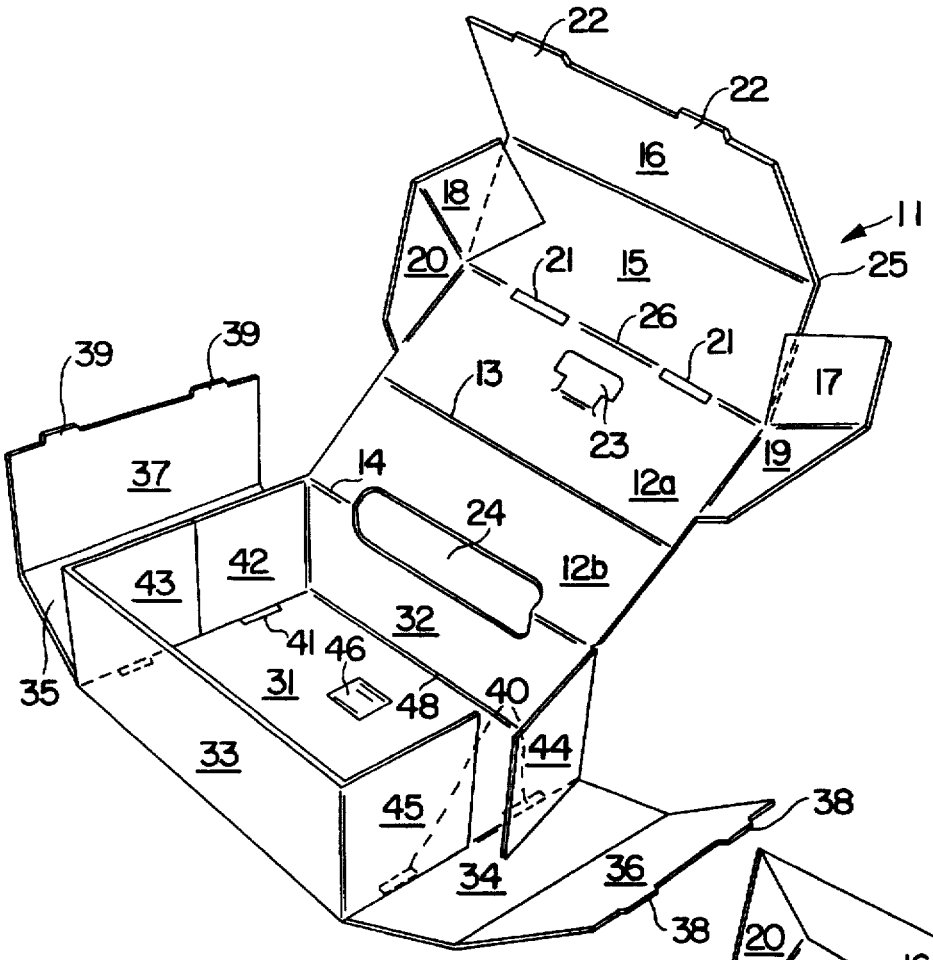
FIG. 3 is a perspective view of the container apparatus being preliminarily deployed into its respective tray portion and container portion.

As shown in FIG. 2, container apparatus 10 is preferably formed out of a single, integrated unitary blank of material. With appropriate cutting and scoring both cover 11 and tray 30 can be formed out of the single blank of material. Cover 11 comprises front top panel **12*a*, rear top panel 12*b*, outer orientation panel 15, inner orientation panel 16, first and second cover support flaps 19 and 20, and first and second wing flaps 17 and 18. In this embodiment, tray 30 comprises bottom panel 31, back panel 32, front panel 33, two side panels 34 and 35, two internal side walls 36 and 37, and internal side support flaps 42–45. As sequentially shown in FIGS. 3 and 4, the unitary blank of FIG. 2 is articulated and deployed so as to ultimately form container apparatus 10. In FIG. 3, container apparatus is in the initial stages of articulation. Specifically, tray 30 is being formed so that front panel 33, and back panel 32 are folded about respective front and back edges 47 and 48 to a position substantially perpendicular to bottom panel 31 but substantially parallel to each other. The internal side support flaps 42, 43, 44 and 45 are then folded about end edges 53, 54, 61 and 62 so as to be substantially perpendicular to front panel 33, back panel 32, as well as bottom panel 31 to, in turn, preliminarily form the periphery of tray 30. Side panels 34 and 35 are likewise folded about respective side edges 50 and 51 to a position substantially perpendicular to bottom panel 31, front panel 33 and back panel 32. In its deployed position side panels 34 rests substantially parallel to and against internal support flaps 44 and 45. On the opposite side of tray 30, side panel 35 is also substantially parallel and resting against internal side support flaps 42 and 43**.

Although not completely deployed in FIG. 3, cover 11 is likewise in its initial stages of articulation. As shown, first and second wing flaps 19 and 20 are traversing from a position substantially planar to top panel 11 to a position substantially perpendicular to front top panel 12*a*. Contemporaneously, first and second cover support flaps 17 and 18 are being folded so as to attain a position no only substantially perpendicular to first and second wing flaps 19 and 20 but also substantially perpendicular to front and rear top panels 12*a* and.

Figure 4:
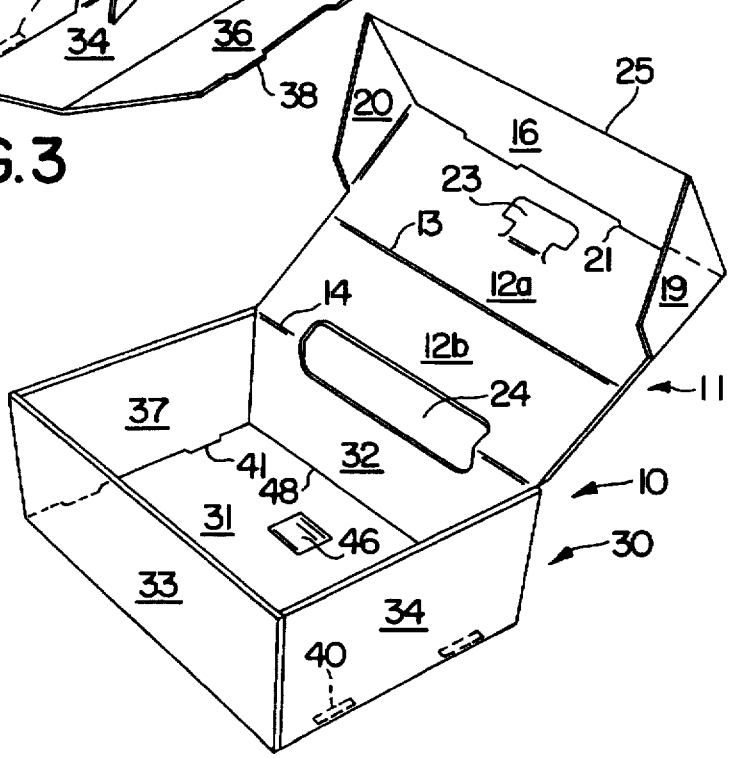
FIG. 4 is a perspective view of the container apparatus of FIG. 3, in which the tray portion is fully articulated and deployed for receipt of articles and the cover portion fully articulated so as to be available for either covering the tray portion or orientation to display the tray portion.

Cover 11 and tray 30, are each fully articulated and deployed in FIG. 4. Internal side walls 36 and 37 have been folded over so as to be substantially parallel to respective side panels 34 and 35. In this manner, internal side support flaps 42, 43, 44 and 45 are sandwiched between inner side walls 36 and 37 and side panels 34 and 35. Tray 30 is then locked into this configuration preferably through the use of a locking tab-aperture combination. Side locking tabs 38 and 39, located on inner walls 36 and 37 respectively are inserted to and engage apertures 40 and 41 positioned in bottom panel 31. While prohibiting inadvertent collapse of tray 30, side locking tabs 38 and 39 are also releasable from apertures 40 and 41.

Cover 11 is also shown in the fully articulated and deployed configuration. Inner orientation panel 16 has been folded about front edge 25 so as to sandwich first and second cover support flaps 17 and 18 between itself and outer orientation panel 15. Cover 11 may then be locked into place to prevent inadvertent collapse, by use of a tab-aperture combination similar to the combination used in tray 30. Locking tabs 22, which are positioned within inner orientation panel 16 are inserted to and engage apertures 21 which are operably positioned within front top panel 12*a*. As with the side locking mechanism of tray 30, locking tabs 22 are removable from apertures 21 to permit planned collapse of cover 11.

Figure 5:
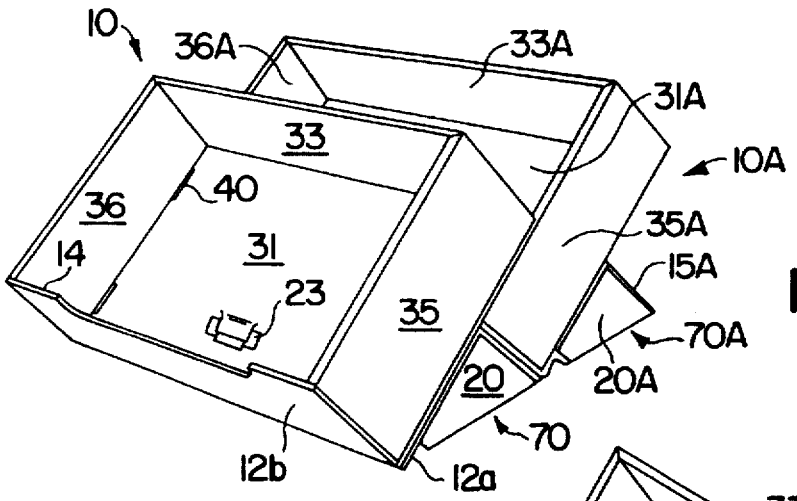
FIG. 5 is a perspective view of a pair of horizontally stacked container apparatus of the present invention wherein each of the subject container apparatuses are deployed so that the cover is positioned to display the tray portion at a substantially 45 degree incline.

FIG. 5 shows a pair of container apparatus 10 and 10*a* wherein each apparatus is in its display configuration for presentation of articles contained within tray 30. As such, cover 11 is folded back out of the way so as to provide clear view of articles contained in tray 30. In this arrangement, top member 12*a*-12*b* is folded about top/back panel fold 14 so that rear top panel 12*b* is adjacent to and overlies front panel 33. Top panel 12*a*-12*b* is then again folded about top panel fold 31 which is adjacent to front edge 47 so that front top panel 12*a* underlies bottom panel 31. Accordingly, an orientation member is formed out of first and second wing flaps 19 and 20, first and second cover support flaps 17 and 18, inner and outer orientation panels 16 and 15, to place tray 30 at an acute angle, preferably 45 degrees, for easy viewing of articles contained inside tray 30—and to ensure non-toppling stackability. Second apparatus 10*a* may then be similarly configured and placed directly behind first container apparatus 10 so that when first container apparatus 10 is removed articles contained in second apparatus 10*a* are ready and available for display.

Figure 6:
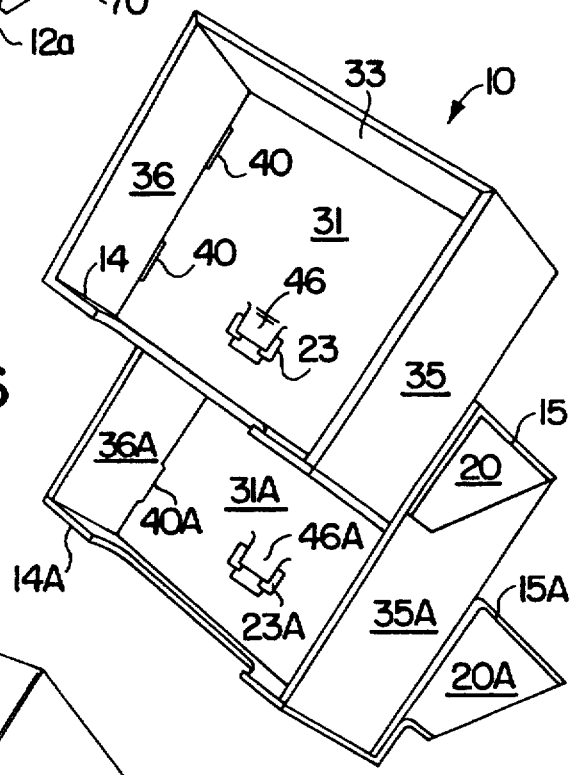
FIG. 6 is a perspective view of a pair of container apparatuses stacked vertically in which the tray portion of both container apparatuses face the same direction.
Figure 7:
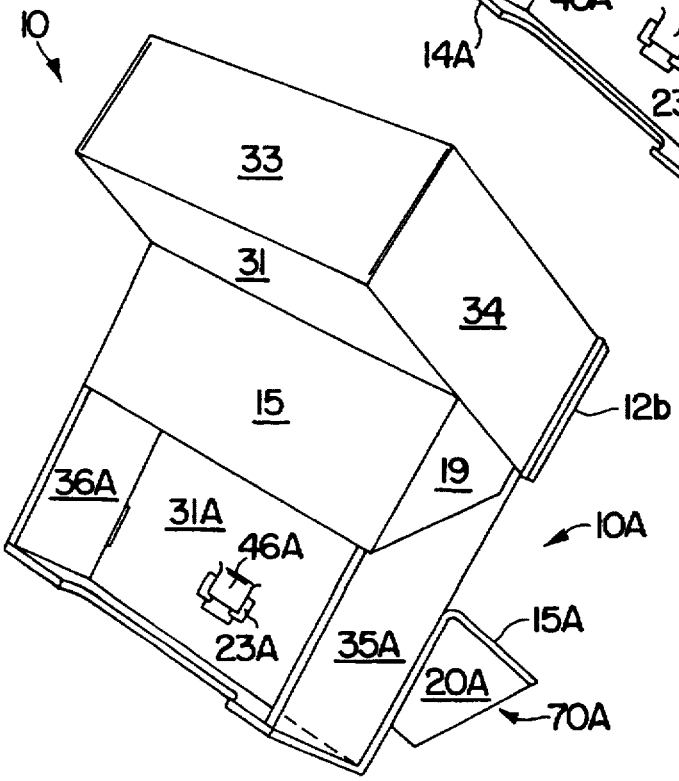
FIG. 7 is a perspective view of a pair of subject container apparatus stacked vertically in which the tray portions of both container apparatus are facing in opposite directions.

Container apparatus 10 may also be stacked vertically as shown in FIGS. 6 and 7. As shown in these figures, tray 30 of the container apparatus 10 when stacked vertically may be facing in either the same or opposite directions. As will be noted from the drawings, when forming the support member out of first and second wing flaps 19 and 20, first and second cover support flaps 17 and 18 and inner and outer orientation panels 15 and 16, an engaging region 70 is additionally formed to telescopically receive a portion of like container. To stack container apparatus 10 upon another similar container, apparatus region 70 is positioned so that inner orientation panel 16, opposite of panel 15, of apparatus 10 is overlaying and adjacent to back panel 32*a* of a second or lower container apparatus 10*a*. If the display areas of the two tray portions are facing in opposite directions as shown in FIG. 7, then pocket 70 of container apparatus 10 is positioned so that front top panel 12*a* is adjacent to and overlaying back panel 32*a* of lower container apparatus 10*a*.

Whether or not container apparatus 10 is being stacked, when positioned in an inclined displaying configuration, cover 11 may be maintained into its display position again by a tab-aperture combination. To fix cover 11 in the displayed configuration locking tab 23 is operably positioned in front top panel 12*a*. Positioned in bottom panel 31 for receipt of tab 23 is alignable aperture 46. When cover 11 is folded back to its display configuration, tab 23 may be inserted into aperture 46 thereby restraining cover 11 in its current position. Furthermore, tension relief aperture 24 is positioned within rear top panel 12*b* and back panel 32 so as to be substantially bisected by top/back panel fold 14. Relief aperture 24 assists in the transition of cover 11 from the container configuration to the display configuration by eliminating, at least partially, the tension caused by folding cover 11 to its display configuration.

The foregoing description and drawings merely explain and illustrate the invention and the invention is not limited thereto except as the appended claims are so limited, as those skilled in the art who have the disclosure before them will be able to make modifications and variations therein without departing from the scope of the invention.

What we claim is:

1. A container apparatus for the packaging, storage and transportation of articles, which may be articulated from a substantially enclosed container configuration to a stackable point-of-purchase display configuration, said container apparatus comprising:

a tray portion and a cover portion capable of being positioned over said tray portion;

said tray portion formed from a bottom panel, a front panel, a back panel and two opposing side panels, said bottom panel having a front edge, a back edge, and opposing side edges;

said front panel foldably emanating from said front edge of said bottom panel and extending substantially perpendicularly to said bottom panel, said front panel having two opposing end edges and an upper edge;

a back panel foldably emanating from said back edge of said bottom panel and extending substantially perpendicularly to said bottom panel, said back panel having two opposing end edges and an upper edge;

two side panels, each of which foldably emanates from said respective opposed side edges of said bottom panel and extending substantially perpendicularly to said bottom panel, each of which said side panels has two opposed end edges and an upper edge, a first end edge of each side panel adjoining an end edge of said back panel and a second end edge of each side panel adjoining an end edge of said front panel, said bottom, front, back, and side panels configured so as to form said tray portion into an open-topped tray enclosure;

said cover portion operably and foldably emanating from said upper edge of said back panel at a top/back panel fold, said cover portion further including a top member operably positioned to overlie said open-topped enclosure tray potion, said top member including a top panel fold dividing said top member into a front top panel and a rear top panel, said rear top panel extending from said top/back panel fold a distance substantially corresponding to the height of said back panel to enable said rear top panel to be reoriented about said top/back panel fold to overlie said back panel in said display configuration, said front top panel overlying substantially one-half of said bottom panel when said apparatus is in said display configuration, said front and rear top panel portions being alternatively orientateable in a substantially flat, co-planar configuration to cover said open-top tray enclosure when said apparatus is in said container configuration, said cover portion further including at least one display orientation member emanating from at least one of said front and rear top panels for maintaining said tray portion in an inclined position within said display configuration, said container apparatus being capable of co-operating with one or more like container apparatuses, upon articulation of same to said respective display configurations, to enable stacking of same in at least one of at least a substantially vertical and a substantially horizontal direction, while exposing substantially one-half of the interior regions of each of said stacked container apparatuses, aside from the uppermost one.

2. The container apparatus according to claim 1, wherein said at least one display orientation member comprises an orientation panel foldably emanating from and restrainably fixed in a position substantially perpendicular to said front top panel.

3. The container apparatus according to claim 2, in which said orientation panel being dimensioned in height and width substantially equal to said front panel of said tray portion so as to be juxtaposed to and overlying said front panel when said apparatus is in said container configuration.

4. The container apparatus according to claim 1 wherein said at least one display orientation member comprises at least one orientation wing, said at least one orientation wing being hingedly attached to at least a portion of said front top panel at the side edges of said front top panel and extending substantially perpendicular thereto and further being dimensioned to incline said tray portion.

5. The container apparatus according to claim 4 wherein said at least one orientation wing further comprises a first and a second wing member, each of which wing members is hingedly attached to at least a portion of said front top panel at the side edges of said front top panel, each said wing members extend substantially perpendicular to said front top panel and said orientation panel and dimensioned in height so as to be substantially equal to said top front panel.

6. The container apparatus according to claim 1 in which said at least one display orientation member comprises an inner and outer orientation panel, first and second wing flaps and first and second cover support flaps, said outer orientation panel having a front edge, a back edge and two opposed side edges and foldably attached to said front top panel at said back edge of said outer orientation panel and extending the length of said front top panel substantially perpendicular to said front top panel, said inner orientation panel being dimensioned substantially equivalent to said outer orientation panel and foldably attached to said outer orientation panel at said front edge of said outer orientation panel, said first and second wing flaps each being foldably attached on opposing sides to at least a portion of said front top panel between said top panel fold and said front edge and extending substantially perpendicular to said front top panel, p1 said first and second cover support flaps foldably emanating from respective said first and second wing flaps so as to be substantially perpendicular to said wing flaps and said front top panel, said inner orientation panel folds about said front edge of said outer orientation panel so that said cover support flaps are positioned between said inner and outer orientation panel.

7. The container apparatus according to claim 6 wherein the invention further includes internal side walls and internal side support flaps, said internal side support flaps foldably emanating from each of said opposing end edges of said front and back panels so as to be foldable to a position substantially perpendicular to said bottom, front and back panels and positioned between said internal side walls and said side panel;

each of said internal side walls foldably emanating from said upper edge of each respective said side panels to fold about said respective upper edge of said side panels to a position substantially perpendicular to said bottom panel and substantially parallel and adjacent to said respective side panels with said internal side support flaps positioned between said internal side walls and said side panels.

8. The container apparatus according to claim 7, in which said inner orientation panel further includes locking means operably positioned so as to restrict movement of said inner orientation panel upon positioning said inner orientation panel overlying said first and second cover support flaps and said outer orientation panel.

9. The container apparatus according to claim 8 wherein said locking means comprises one or more locking tab and aperture combinations, said one or more locking tabs positioned within said inner orientation panel for removable insertion into a respective one or more apertures operably positioned within said front top panel to restrain said cover portion into a particular configuration.

10. The container apparatus according to claim 9, in which each of said internal side walls further includes tray portion locking means operably positioned so as to restrict movement of said internal side walls upon folding said internal side walls to a position substantially perpendicular to said bottom panel.

11. The container apparatus according to claim 10 in which said tray portion locking means comprises one or more side locking tab and aperture combinations, said one or more side locking tabs positioned within said internal side walls for removable insertion into said respective one or more apertures positioned within said bottom panel and proximate to said side edges of said bottom panel.

12. The container apparatus according to claim 1 in which said display orientation member maintains said tray portion at a substantially 45 degree angle of incline in said display configuration.

13. The container apparatus according to claim 1 in which said invention includes one or more display locking members for retaining said top member in its position proximate and underlying said bottom panel of said tray portion when said apparatus is in said display configuration.

14. The container apparatus according to claim 13 wherein said one or more display locking members comprises a locking tab and aligned aperture for lockable receipt thereof, said locking tab being positioned within one of said front top panel and said bottom panel, while said aperture being operably positioned in the other of said front top panel and said bottom panel, for fixed receipt of said locking tab in said aperture upon articulation of said apparatus to said display configuration.

15. The container apparatus according to claim 1, wherein at least a portion of said rear top panel and a portion of said back panel share a common tension relief aperture positioned between said side edges of said back panel and which is substantially bisected by said top/back fold so as to diminish tension on said top/back panel fold when said apparatus is in said display configuration.

16. The container apparatus according to claim 1 in which said tray portion and said cover portion are collectively formed of a unitary blank of material.

17. The container apparatus according to claim 1 in which said tray portion and said cover portion are formed of substantially biodegradable material.

18. The container apparatus according to claim 1 in which said tray portion and said cover portion are formed from paperboard material.

19. The container apparatus according to claim 1 in which said tray portion and said cover portion are formed from a corrugated paperboard material.

* * * * *

UNITED STATES PATENT AND TRADEMARK OFFICE

CERTIFICATE OF CORRECTION

PATENT NO. : 5,894,933
DATED : April 20, 1999
INVENTOR(S) : Mitchell S. Crews and Michael M. Lloyd It is certified that error appears in the above-identified patent and that said Letters Patent is hereby corrected as shown below:

Column 5,
Line 4, after "position", change "no" to -- not --
Line 7, after "and" insert -- 12b --

Column 6,
Line 67, after "tray", change "potion" to -- portion --

Signed and Sealed this

First Day of April, 2003

JAMES E. ROGAN
*Director of the United States Patent and Trademark Office*